United States Patent [19]

Hoshall

[11] Patent Number: 4,726,083

[45] Date of Patent: Feb. 23, 1988

[54] BOXSPRING-MATTRESS SET EMPLOYING SLIDE-PREVENTING MEANS

[76] Inventor: Vicki S. Hoshall, 8805 Arlington Expressway, Jacksonville, Fla. 32211

[21] Appl. No.: 369,421

[22] Filed: Apr. 19, 1982

[51] Int. Cl.[4] ..... A47C 27/00

[52] U.S. Cl. ..... 5/411; 297/DIG. 6; 5/448

[58] Field of Search ..... 5/402, 411, 470, 471; 297/219, DIG. 6

[56] References Cited

U.S. PATENT DOCUMENTS

| | | | |
|---|---|---|---|
| 687,400 | 11/1901 | Marcus | 5/411 |
| 2,417,333 | 3/1947 | Waetzman | 5/411 |
| 2,588,854 | 3/1952 | Lang | 5/411 |
| 2,995,762 | 8/1961 | Albinson | 5/411 |
| 3,049,729 | 8/1962 | Broyles . | |
| 3,279,849 | 10/1966 | Radke et al. | 297/DIG. 6 |
| 3,283,345 | 11/1966 | Berck | 5/471 |
| 3,446,531 | 5/1969 | Froelich | 297/DIG. 6 |
| 3,603,639 | 9/1971 | Wilson | 297/DIG. 6 |
| 3,837,020 | 9/1974 | Bosch . | |
| 4,074,373 | 2/1978 | Garofalo | 5/411 |
| 4,383,713 | 5/1983 | Roston | 297/DIG. 6 |

FOREIGN PATENT DOCUMENTS

| | | | |
|---|---|---|---|
| 2464066 | 4/1981 | France | 297/219 |

*Primary Examiner*—Alexander Grosz
*Assistant Examiner*—Michael F. Trettel

[57] ABSTRACT

A boxspring and mattress set of the type wherein the boxspring has a flat upper surface and a peripheral edge includes a mattress likewise having a flat surface adapted to rest on the surface of the boxspring, the peripheral edge of the mattress corresponding to the edge of the boxspring. The set is provided with a hook-and-pile fastener with the pile portion thereof affixed to the flat surface of the mattress and the hook portion thereof affixed to the flat surface of the boxspring opposite the pile portion, both the hook and pile portions being respectively disposed away from the peripheral edge of the mattress and boxspring so as to remain hidden from view when the mattress overlies the boxspring with the peripheral edges thereof in corresponding relationship.

9 Claims, 2 Drawing Figures

BOXSPRING-MATTRESS SET EMPLOYING SLIDE-PREVENTING MEANS

BACKGROUND OF THE INVENTION

1. Field of the Invention

The present invention relates to boxspring and mattress combination sets, and more particularly relates to means provided with such boxspring-mattress sets to retain the mattress in its proper position over the boxspring, to prohibit relative movement between the boxspring and the mattress, yet further allowing the edges of the mattress to be lifted during the making of the bed.

It is a recognized problem that boxspring-mattress sets have surfaces which permit sliding movement between the two. Thus, during normal use, the mattress will occasionally slide over the peripheral edge of the boxspring, a condition which permits the sheet over the mattress to become disengaged, and which may render the mattress much less comfortable than if the mattress is properly located.

2. Description of the Prior Art

There have been a number of suggestions in the prior art for arrangements to prohibit sliding movement between the mattress and boxsprings in a bed set.

Hawkins, in U.S. Pat. No. 3,520,030, discloses a mattress stay comprising straps diagonally across the corners of the boxspring with one end of each strap attached to the opposite corner of the mattress. This arrangement permits limited lifting of the mattress for purposes of making the bed, but prohibiting sliding of the mattress during use.

Bosch, U.S. Pat. No. 3,837,020, discloses a mattress and bedspring combination in which the mattress is selectively attachable to the foundation in such a manner as to prohibit shifting movement between the two. This is obtained by the utilization of a plurality of tufted layers of differing density, the layer arranged adjacent the foundation being the most firm with the softest layer spaced fartherest from the foundation.

Hemmeter, in U.S. Pat. No. 4,017,919, discloses a mattress guard formed of a plastic-clad wire having a horizontal portion extending beneath the corner of the boxspring, and vertical portions extending upwardly adjacent the sides of the boxspring and mattress. The arrangement taught by Hemmeter effectively constitutes a corner device that prevents the mattress from sliding over the edges of the boxspring at the corner. This arrangement immobilizes the mattress and keeps it properly aligned with the boxspring.

Karpen, U.S. Pat. No. 2,556,924, discloses the use of a single muslin strip so arranged that a side pocket is provided for the tucking in of sheets and the like, the strip providing a common casing at the bottom of the mattress and the top of the boxspring.

SUMMARY OF THE INVENTION

The present invention contemplates a bedding system comprising a boxspring adapted to rest upon a floor or other supporting surface. The boxspring defining an upper flat surface having a peripheral edge. The system further includes a mattress having opposing flat surfaces, each opposing flat surface of the mattress adapted to rest upon the upper flat surface of the boxspring with each opposing flat surface of the mattress having a peripheral edge. Fastening means are provided on each of the flat surfaces of the boxspring and mattress for holding the mattress fast to the boxspring and for preventing relative movement therebetween.

In the preferred embodiment of the present invention, the fastening means comprising a hook-and-pile fastener including a fabric pile portion disposed on the flat surfaces of the mattress.

Further in accordance with the preferred invention, the hook-and-pile fastener are disposed away from the respective peripheral edge of the mattress and boxspring so as to remain hidden from view when the mattres overlies the boxspring with the peripheral edge thereof corresponding to the peripheral edge of the boxspring.

In order to achieve coupling to the respective flat surfaces of the boxspring and mattress, each portion of the hook-and-pile fastener is provided with an adhesive layer between the fastener portion and the respective flat surface. Perferably, the adhesive layer is heat sensitive, so as to permit the respective hook or pile portion of the fastener to be fastened at the predetermined location by ironing the fastener portion, together with the heat sensitive adhesive layer, directly onto the respective flat surface of the mattress or boxspring.

DETAILED DESCRIPTION OF THE DRAWINGS

DETAILED DESCRIPTION OF THE PREFERRED EMBODIMENT

A detailed description of the preferred embodiment will now be described with reference to FIGS. 1 and 2.

Figure 1:
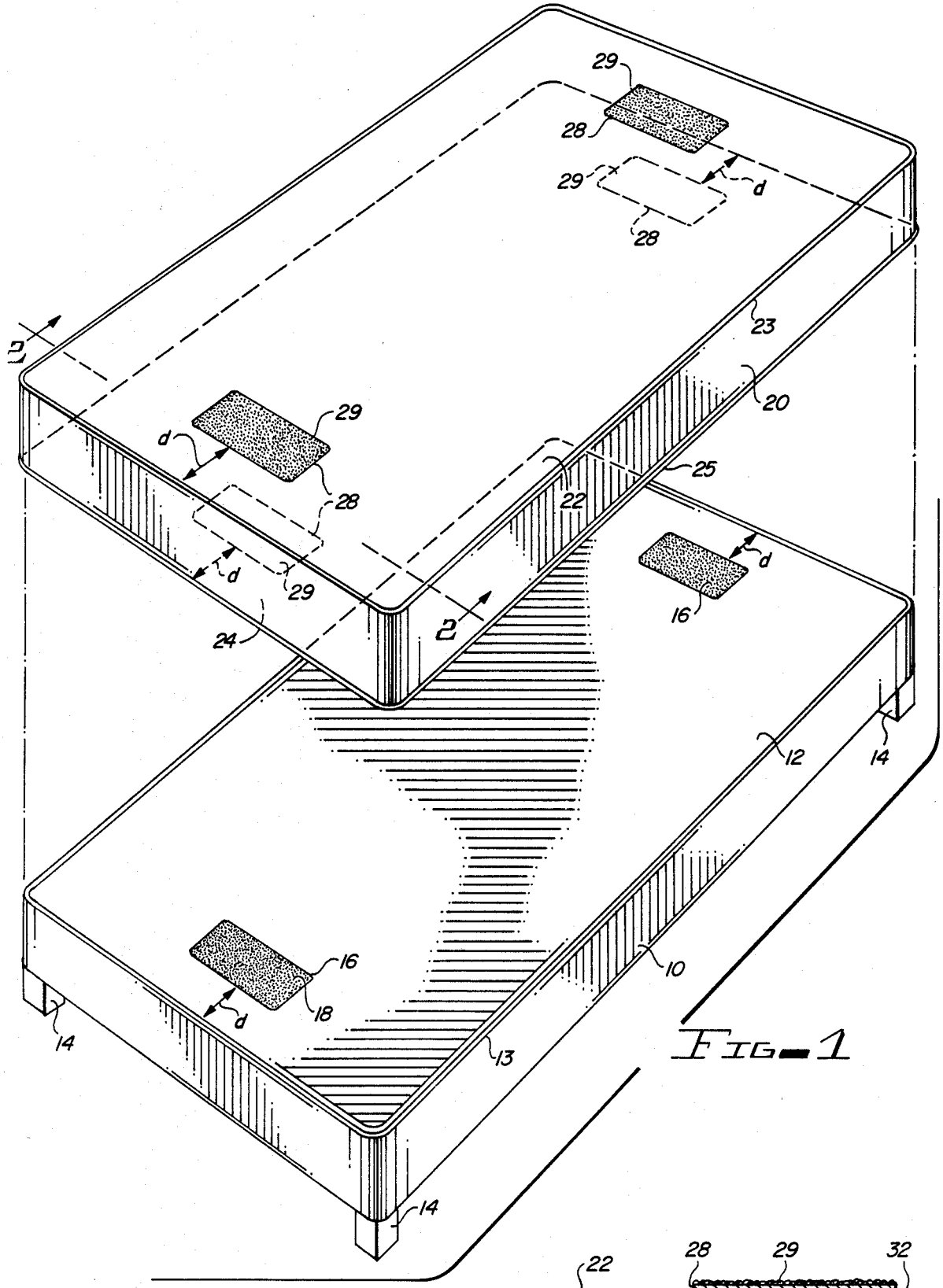
FIG. 1 is an exploded perspective view illustrating a boxspring and mattress combination in accordance with the present invention.

With reference first to FIG. 1, there is shown a conventional boxspring 10 adapted to rest upon a floor or other supporting surface, the boxspring defining an upper flat surface 12 having a peripheral edge 13, the boxspring 10 further including a set of legs 14. The system further includes a conventional mattress 20 having opposing flat surfaces 22 and 24, each opposing flat surface adapted to rest upon the flat surface 12 of the boxspring 10 with each opposing flat surface of the mattress having a respective peripheral edge 23, 25.

In accordance with the present invention, the bedding system, including the boxspring 10 and the mattress 20, is provided with fastening means on each of the flat surfaces 12, 22 and 24 for holding the mattress 20 fast to the boxspring 10 and for preventing relative movement therebetween. In a preferred embodiment of the present invention, this means comprises a fabric connector disposed on each flat surface 22, 24 of the mattress 20. The fabric connector comprises the fabric pile portion 29 of a hook-and-pile fastener. The fastener further includes a hook portion 16 disposed on the flat surface 12 of the boxspring 10. As is shown in FIG. 1, each of the hook-and-pile fasteners 16, 29 are disposed a distance D from the respective peripheral edge, so as to match the corresponding hook or pile fastening portion.

Preferably, the distance D comprises a distance on the order of 6 to 12 inches.

Further in accordance with the present invention, each pile portion 29 of the fastener is affixed to a fabric backing 28.

Figure 2:
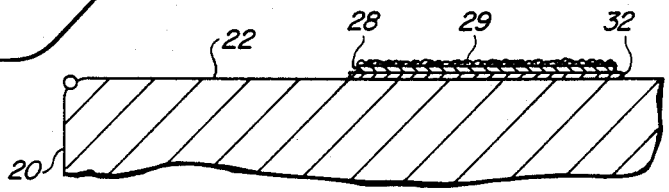
FIG. 2 is a cross-sectional elevation of a portion of the mattress shown in FIG. 1.

As is shown in greater detail in FIG. 2, the pile portion of 29 has a fabric backing 28, which fabric backing is affixed to the respective flat surface 22, 25 of the mattress via a heat-sensitive adhesive layer 32.

As will be appreciated by those skilled in the art, the hook-and-pile fasteners 18, 29 are disposed away from the respective peripheral edges of the mattress 20 and boxspring 10 so as to remain hidden from view when the mattress overlies the boxspring with the peripheral thereof corresponding to each other.

Preferably, the mattress is provided with two hook-and-pile fasteners at opposite ends of the boxspring, and similarly, the mattress is provided with additional pile portions at the opposing end, to permit the opposite end to be anchored in place.

In use, the fastening means of the present invention may be provided in a facile kit package, with the adhesive layer 32 such that it may be adhered to the flat surface 12 of the boxspring 10, or alternatively, to the flat surfaces 22, 25 of the mattress 20 through a heat treatment by the use of an electric iron or some similar heating means.

I claim:

1. A bedding system comprising:

(a) a boxspring adapted to rest upon a floor or other supporting surface, said boxspring defining an upper flat surface having a peripheral edge;

(b) a mattress having opposing flat surfaces, each opposing flat surface of said mattress adapted to rest upon said upper flat surface of said boxspring with each opposing flat surface of said mattress having a peripheral edge; and (c) fastening means on each of said flat surfaces of said boxspring and mattress for holding said mattress fast to said boxspring and for preventing relative movement therebetween, said fastening means including a fabric connector disposed on each flat surface of said mattress, said fabric connector comprising the fabric pile portion of a hook-and-pile fastener.

2. The bedding system recited in claim 1 further comprising the hook portion of said hook-and-pile fastener disposed on said flat surface of said boxspring.

3. The bedding system recited in claim 2 wherein said hook portion of said fastener is disposed on said flat surface of said boxspring at a point several inches from the peripheral edge thereof.

4. The bedding system recited in claim 3 wherein said pile portions of said fastener are disposed on the respective flat surfaces of said mattress at a point opposite said hook fastener when said mattress overlies said boxspring.

5. The bedding system recited in claim 4 wherein said peripheral edge of said mattress has a dimension corresponding to the peripheral edge of said boxspring, whereby alignment of each said pile portion with the hook portion is obtained through the alignment of the peripheral edge of said mattress with the peripheral edge of said boxspring.

6. The bedding system recited in claim 5 further comprising an adhesive layer between each of said hook and pile portions and the respective flat surface.

7. The bedding system recited in claim 6 wherein said adhesive layer is heat sensitive.

8. The bedding system recited in claim 7 further comprising additional fastening means adjacent the peripheral edges of said mattress and boxspring along the side opposite said first-recited fastening means.

9. The bedding system recited in claim 1 wherein said fastening means is hidden from view when said mattress overlies said boxspring, with the peripheral edge thereof corresponding to the peripheral edge of said boxspring.

* * * * *